United States Patent [19]

Harris et al.

[11] 4,172,541

[45] Oct. 30, 1979

[54] ROTATABLY CAPPED CONTAINER OUTLET WITH CLICK-STOP UPON CLOSING

[76] Inventors: Michael J. Harris, "Alcatraz", 95 Boeing Rd. East, Bedfordview, Transvaal Province; Anthony R. Clausen, 7 Klip St., Observatory, Johannesburg, Transvaal Province, both of South Africa

[21] Appl. No.: 843,045

[22] Filed: Oct. 17, 1977

[30] Foreign Application Priority Data

Oct. 18, 1976 [ZA] South Africa ..... 76/6195

[51] Int. Cl.[2] ..... B65D 41/06

[52] U.S. Cl. ..... 222/519

[58] Field of Search ..... 222/549, 519, 562, 499, 222/553

[56] References Cited

U.S. PATENT DOCUMENTS

| | | | |
|---|---|---|---|
| 1,590,822 | 6/1926 | Heath | 222/519 |
| 1,615,127 | 1/1927 | McNaughton | 222/519 |
| 1,631,525 | 6/1927 | Gallett | 222/553 |
| 1,795,737 | 3/1931 | Rundell | 222/549 X |
| 2,533,915 | 12/1950 | Brooks | 222/549 X |
| 3,029,003 | 4/1962 | Gronemeyer | 222/553 |

*Primary Examiner*—Stanley H. Tollberg

*Attorney, Agent, or Firm*—Cushman, Darby & Cushman

[57] ABSTRACT

This invention relates to a closure member in the form of a hollow tubular outlet member and a cap fitting over the outlet member and rotatable relative thereto, the outlet member and cap having complementary conical end portions, an aperture in each conical end portion which can be aligned to define an opening which can be closed by rotation of the cap and wherein the cap and outlet have a co-axial tubular portion, one of such tubular portions being provided with at least one formation directed towards the other tubular portion and co-operating with a cam surface on the said other tubular portion, said cam surface being shaped such that the conical end portions are urged axially into tighter engagement with each other during rotation of the cap to close the opening.

8 Claims, 8 Drawing Figures

ROTATABLY CAPPED CONTAINER OUTLET WITH CLICK-STOP UPON CLOSING

This invention relates to closures which may be used for releasably closing off any type of outlet as required.

Of particular interest is a closure for a container and of still more particular interest are closures for flexible tubes such as toothpaste, shampoo and cosmetic containing tubes. However, the invention is in no way confined in application to such closures and includes within its scope, closures such as those used for bleeding air out of liquid containing systems and dispensing containers for pharmaceutical products in either liquid or unit dosage form.

It is the object of this invention to provide a closure which, has a sufficiently large aperture for allowing passage of a substance therethrough, provides an effective seal in the closed condition thereof, and wherein the closure member itself is permanently associated with the outlet with which it co-operates and is moved from an open to a closed position by a simple rotational movement.

In accordance with this invention there is provided a closure assembly comprising a hollow tubular outlet member and a cap fitting over the outlet member and rotatable relative thereto, the outlet member and cap having complementary conical end portions, an aperture in each conical end portion which can be aligned to define an opening which can be closed by rotation of the cap and wherein the cap and outlet each have a co-axial tubular portion, one of such tubular portions being provided with at least one formation directed towards the other tubular portion and co-operating with a cam surface on the said other tubular portion, said cam surface being shaped such that the conical end portions are urged axially into tighter engagement with each other during rotation of the cap to close the opening.

Further features of the invention provide for the cam surface to be shaped to provide a "click" stop in the closed condition, for the tubular outlet to be integral with at least a shoulder portion of a container or for the outlet to be provided with a spigot or socket to enable it to be connected to a complementary socket or spigot.

Still further features of the invention provide for both the cap and outlet to be manufactured from injection moulded plastics material and for the cap to be a snap-fit onto the outlet for assembly purposes.

The above and other features of the invention will become more apparent from the following description of one embodiment thereof. In this description reference will be made to the accompanying sketches in which.

Figure 1:
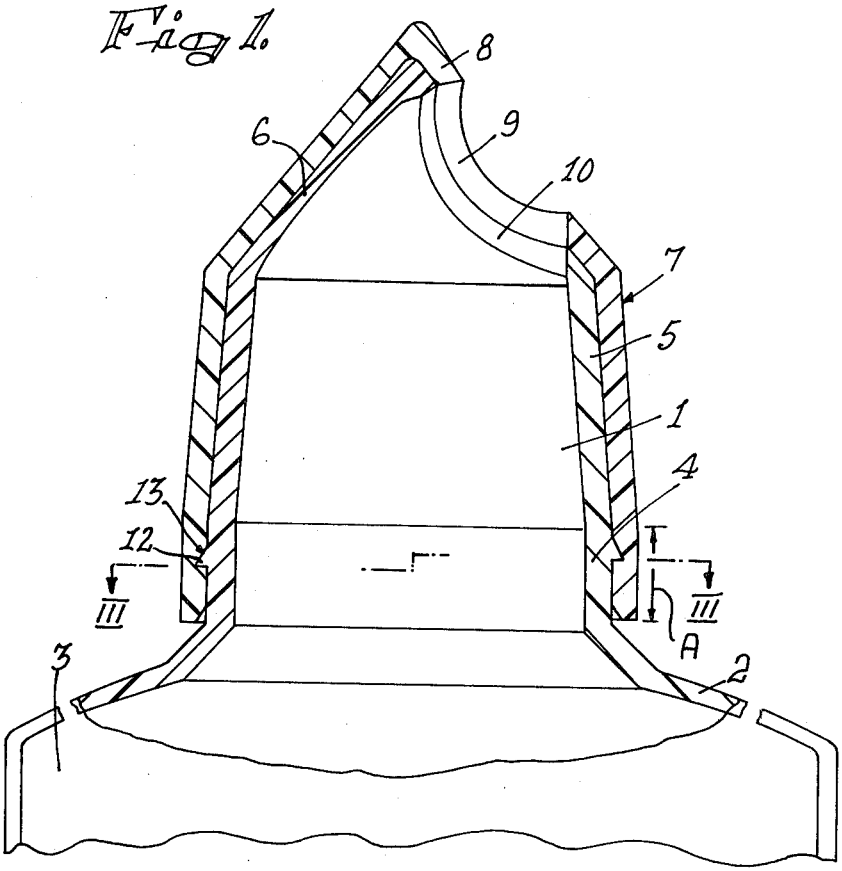
FIG. 1 is a sectional elevation of a closure assembly.
Figure 2:
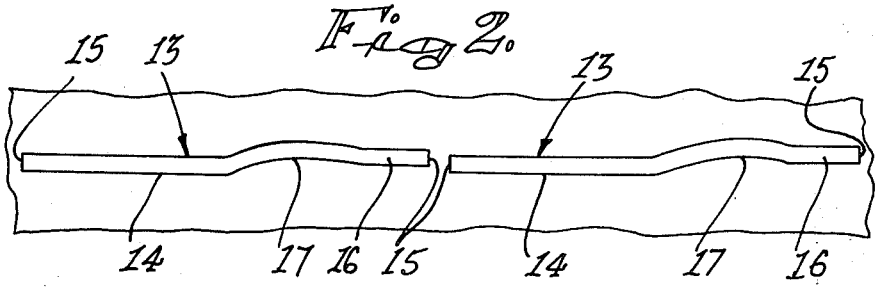
FIG. 2 is a development of the portion indicated by arrow "A" in FIG. 1 of the cap illustrating the shape of the cam grooves.
Figure 3:
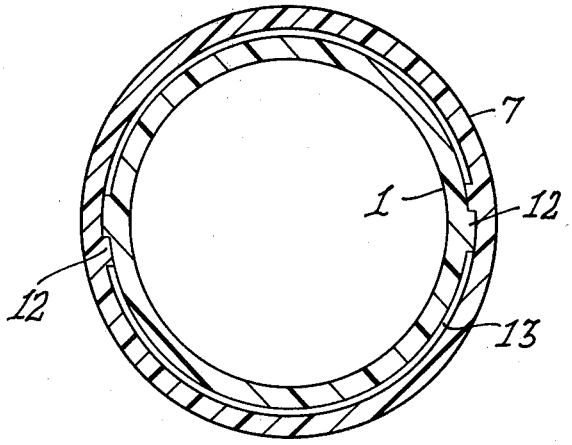
FIG. 3 is a cross-section taken along line III—III in FIG. 1.
Figure 4:
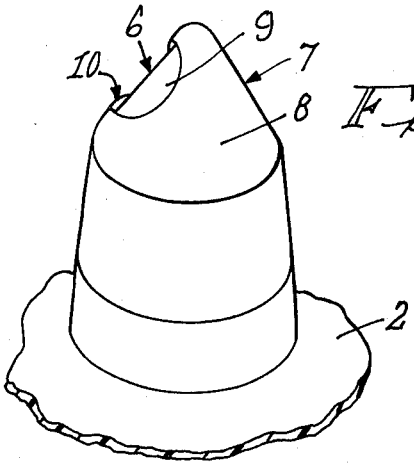
FIG. 4 is an isometric view of the closure assembly in a closed condition.
Figure 5:
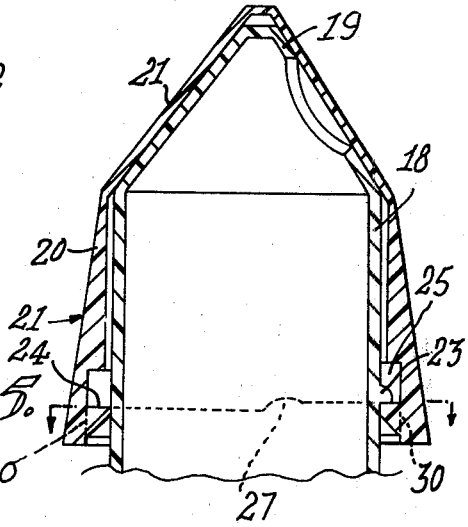
Figure 6:
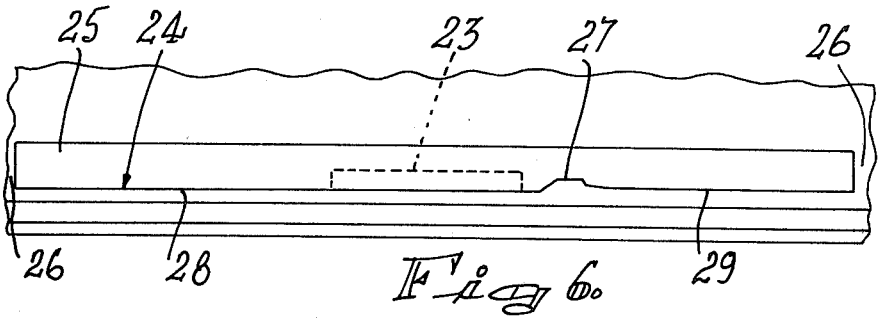
Figure 7:
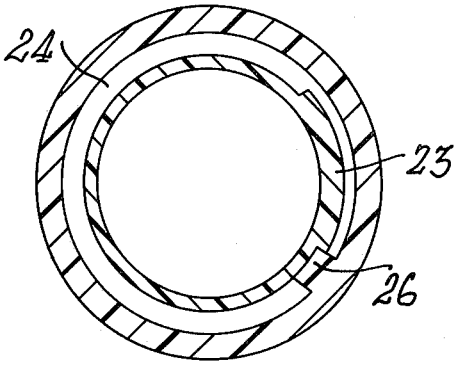
Figure 8:
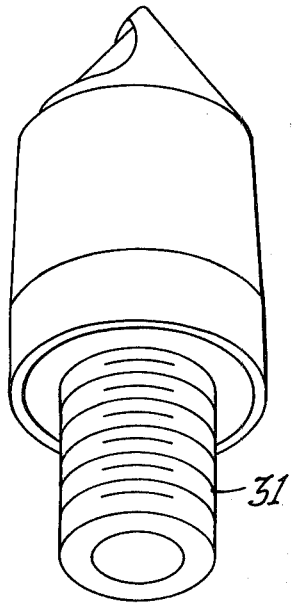

FIGS. 5, 6, and 7 are views similar to FIGS. 1, 2 and 3 but of a modified form of the embodiment illustrated therein; and, FIG. 8 illustrates in isometric view the application of the invention to a bleeding valve.

In the embodiment of the invention illustrated in FIGS. 1 to 4 the invention is applied to a closure for a flexible cosmetics tube, such as a toothpaste tube. In this application of the invention a tubular outlet 1 is formed integral with a shoulder portion 2 of a tube 3 with which the shoulder portion may be integral if required. The tubular outlet is formed in three sections whereof a section 4 adjacent the shoulder is of constant circular cross-section; a second section 5 more removed from the shoulder tapers slightly inwardly whilst being of circular cross-section, and a third section 6 defines an end to the outlet and is of conical shape.

A cap 7 of complementary shape to the outlet fits over the latter and is formed such that the adjacent surfaces of the outlet and cap are substantially in contact throughout their area. Since the conical end portions serve to centre the cap on the outlet, it is not essential that the slightly tapered section 4 and cylindrical end portion 3 be tightly in contact with the adjacent cap surfaces and a small space can, in fact, be provided. The conical portions 8 and 6 of the cap and outlet respectively are each provided with apertures 9 and 10 respectively in the walls of the conical portions. The cone angle is selected so that a aperture of reasonable diameter can be provided relative to the diameter of the tubular outlet. These two diameters can, in many instances, be of comparable size. A preferred cone angle is thus about 80°.

In order to facilitate injection molding from plastics material, the lower region 11 of each aperture has its edge substantially parallel to the axis of the outlet to allow for withdrawal of a male mold member from the molded article located in a female mold member. At least in the case of the cap this provides an aperture which increases in diameter from the outer surface to the inner surface thereof, thereby providing an inclined edge to the aperture. In use, this inclined edge has the effect of wiping material back into the outlet during closure of the cap.

The apertures and adjacent inner surface of the conical portion 6 of the outlet are shaped substantially smoothly to provide an outlet passage which will not interfere to any appreciable extent with the dispensing of, for example, toothpastes having stripes of mouthwash or the like therein.

The portion 4 of the outlet of constant circular cross-section has on the outer surface thereof a pair of diametrically outwardly extending formations 12 which extend into grooves 13 defining cam surfaces in the inner surface of the cap. It will be understood that the operative cam surface is provided by the lower sidewall 14 of the groove since the sidewall co-operates with the formations 12.

There are two identical grooves 13 as shown clearly in FIG. 2 and each is adapted to co-operate with its associated formation in an identical manner. The grooves provide for approximately 170° of rotation of the cap relative to the outlet and the ends 15 of the grooves define stops limiting further rotation of the cap. The grooves extend circumferentially for approximately a 90° angle which corresponds to the various degrees of correspondence of the apertures in the cap and outlet. The grooves then become somewhat upwardly inclined and again downwardly inclined in the axial direction relative to the apertures to terminate in end portions 16 of the grooves. The end portions correspond to the locked closed position. The end portions are further located so that they are axially displaced from the major portion of the length of the grooves in a manner ensuring that a slight axial movement of the cap into tighter engagement with the outlet is promoted when the cap is rotated to a locked position. This axial movement may be very small and, in fact, it is envisaged that with fairly accurately moulded components, an axial movement of approximately 0.1 to 0.2 mm is all that will be required. The inclined portions provide a raised region 17 of the groove which ensures that the cap cannot rotate out of the locked closed position without overriding this raised portion. The latter structure provides what is commonly termed a "click" stop in the closed position of the cap.

It will be understood that rotation of the cap between a closed and open position can easily be effected using the thumb of a hand used to hold an article carrying such a closure. To this end the cap may be provided with any type of formation or friction affording surface to ensure that this can be effected easily.

A slightly modified form of the invention is illustrated in FIGS. 5 to 7. In this instance the tubular outlet 18 is of substantially constant diameter up to the position where it joins up with the conical portion 19. The cap 20 is dimensioned to be a fractionally loose fit on the outlet and has a conical outer surface 21 to provide a thickened region in the wall remote from the conical portion 22 of the cap.

The outlet in this case has a single outwardly directed formation 23 in the form of a flange extending circumferentially around the outer in an arc of about 60° to 80°. This single formation co-operates with an annular cam surface 24 directed towards the conical end portions and defining one wall to a groove 25 in the inner surface of the cap towards its lower end. The groove extends around substantially the entire circumference of the cap but for a short portion 26 which defines a stop to prevent the cap from being rotated by more than about 275°.

The cam surface has a single raised portion 27 joining a large portion 28 of the cam surface and a smaller portion 29 thereof. The smaller portion 29 is, as above described, in respect of each half of the groove 13, somewhat nearer the conical end portion than the larger portion 28. This provides the slight clamping action of the cap upon closure thereof and will not be further described.

The cam surface 24 in this case could be provided on a separate ring which fits into the cap to provide a join as indicated by dotted lines 30 in FIG. 5. These two parts would be bonded together at this join upon assembly of the closure. The purpose of making such a separate ring would only be to avoid the use of a collapsible female die for forming the groove in the interior of the cap.

In use the closure assembly just described will function in the same way as that described with reference to FIGS. 1 to 4.

As mentioned above the outlet will generally be integral with at least a shoulder portion of a container but it may equally well be integral with a lid for a container other than a tube. Also the outlet could be formed with a socket at its open end so that it can be installed on an existing screw threaded spigot associated with a dispensing tube for example.

In addition, as shown in FIG. 8, the outlet may be provided with a screw threaded spigot 31 to enable it to be installed in a socket or screw threaded hole in a pipeline as a bleeder valve for gasses contained in liquid streams for example. In such application it will be appreciated that the closure may be made of metal for high pressure use and in such a case an O-ring may be installed around the aperture in the outlet so that the cap seals on to the O-ring in the closed position.

Many variations may be made to the above described embodiment of the invention without departing from the scope hereof. In particular, the groove having the cam surface associated therewith could be provided in the outer surface of the outlet and the co-operating formation(s) could be provided on the inner surface of the cap.

What we claim as new and desire to secure by Letters Patent is:

1. A closure assembly, comprising:

a hollow tubular outlet member; and a cap fitting over the outlet member and being rotatable relative thereto;

said outlet member and said cap having wall means defining complementary conical end portions;

means defining an aperture in each said conical end portion which apertures can be aligned by rotation of the cap relative to the outlet member to define an opening and which can be offset by rotation of the cap relative to the outlet member to close said opening;

the cap and outlet each having wall means defining a co-axial tubular portion;

one of such tubular portions being provided with at least one formation directed towards the other such tubular portion;

said other such tubular portion being provided with a cam surface cooperating with said at least one formation;

said cam being shaped such that said conical end portions remain substantially axially stationary relative to each other during initial rotation of the cap from when said apertures are aligned and define said opening, in a sense to offset and thus close the opening, but once the opening is closed, further offsetting rotation of the cap causes said conical end portions to be urged axially into tighter engagement with each other; and said cam surface further being shaped to provide a click stop for when said apertures are fully offset and said conical end portions are urged axially into said tighter engagement.

2. A closure assembly as claimed in claim 1 in which the tubular outlet is integral with at least a shoulder portion of a container.

3. A closure assembly as claimed in claim 2 in which the shoulder portion is, in turn, integral with a body of the container.

4. A closure assembly as claimed in claim 1 in which the outlet is provided with a spigot or socket for enabling connection thereof to a complementary socket or spigot.

5. A closure assembly as claimed in claim 1 in which the cap is a snap-fit onto the outlet.

6. A closure assembly as claimed in claim 1 in which the cap and outlet are made from injection moulded plastics material.

7. In combination, a container having an outlet provided with the closure assembly of claim 1 as a closure means for said outlet thereof.

8. A closure assembly as claimed in claim 1, in which:

said at least one formation is constituted by surface means defining a generally horizontal, angularly extending, radially opening groove having an initial, first-level segment and a terminal, second, different-level terminal segment, separated from one another by an intermediate, arching segment; and said cam surface being constituted by superficial means on a protuberance received in said groove in sliding engagement with said surface means of said groove;

the initial, intermediate and terminal segments of said groove being so situated and extensive that when said protuberance is received in said initial segment of the groove said conical portions are relatively less-tightly axially pressed together and said apertures may be aligned to define said opening, and when said protuberance is received in said terminal segment of the groove said conical portions are relatively more-tightly axially pressed together and said apertures are completely offset, closing said opening, the intervention of said intermediate segment providing said click stop by necessitating that in order to rotate the cap in a sense to carry the protuberance from the terminal segment to the initial segment said conical portions must be temporarily axially forced even more tightly together in order for the protuberance to slidingly traverse the arching intermediate segment of the groove.

* * * * *